US011851997B2

(12) United States Patent
Downey

(10) Patent No.: US 11,851,997 B2
(45) **Date of Patent: *Dec. 26, 2023**

(54) SYSTEM AND METHOD FOR OPTIMIZED PRODUCTION OF HYDROCARBONS FROM SHALE OIL RESERVOIRS VIA CYCLIC INJECTION

(71) Applicant: Shale Ingenuity, LLC, Centennial, CO (US)

(72) Inventor: Robert A. Downey, Centennial, CO (US)

(73) Assignee: Shale Ingenuity, LLC, Centennial, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/226,956

(22) Filed: Apr. 9, 2021

(65) Prior Publication Data

US 2021/0317733 A1 Oct. 14, 2021

Related U.S. Application Data

(60) Provisional application No. 63/008,322, filed on Apr. 10, 2020.

(51) Int. Cl.

| | |
|---|---|
| ***E21B 43/25*** | (2006.01) |
| ***E21B 43/16*** | (2006.01) |
| ***E21B 43/26*** | (2006.01) |
| ***E21B 43/40*** | (2006.01) |
| ***E21B 49/00*** | (2006.01) |

(52) U.S. Cl.

CPC ..... *E21B 43/255* (2013.01); *E21B 43/168* (2013.01); *E21B 43/2605* (2020.05); *E21B 43/2607* (2020.05); *E21B 43/40* (2013.01); *E21B 49/00* (2013.01); *E21B 2200/20* (2020.05)

(58) Field of Classification Search

None

See application file for complete search history.

(56) References Cited

U.S. PATENT DOCUMENTS

| | | | |
|---|---|---|---|
| 5,413,177 | A | 5/1995 | Horton |
| 5,607,016 | A | 3/1997 | Butler |
| 9,725,644 | B2 | 8/2017 | Babcock et al. |

(Continued)

FOREIGN PATENT DOCUMENTS

| | | | | |
|---|---|---|---|---|
| WO | WO 2007098606 | * | 9/2007 | ..... E21B 43/267 |
| WO | WO 2011150486 | * | 12/2011 | ..... E21B 43/34 |

OTHER PUBLICATIONS

Alharthy, N., Teklu, T, Kazemi, H., Graves, R., Hawthorne, S., Branuberger, J., and Kurtoglu, B., 2018. "Enhanced Oil Recovery in Liquid-Rich Shale Reservoirs: Laboratory to Field." SPE 175034 ("Alharthy 2018").

(Continued)

*Primary Examiner* — Anuradha Ahuja

(74) *Attorney, Agent, or Firm* — Dickinson Wright PLLC; Ross Spencer Garsson

(57) ABSTRACT

Method for production of hydrocarbons from shale oil reservoirs via a cyclic injection and production process. The method determines the composition of injected hydrocarbon-containing composition to be injected, performing injection and production steps, and then re-determines the composition of the injected hydrocarbon-containing composition to be injected.

12 Claims, 6 Drawing Sheets

(56) References Cited

U.S. PATENT DOCUMENTS

| | | | | |
|---|---|---|---|---|
| 9,840,899 | B2 | 12/2017 | Murrell | |
| 9,932,808 | B2 | 4/2018 | Sheng | |
| 10,487,635 | B2 | 11/2019 | Sheng | |
| 11,280,170 | B2 | 3/2022 | Gould et al. | |
| 11,506,815 | B2 | 11/2022 | Johns et al. | |
| 11,624,271 | B1 | 4/2023 | Gould et al. | |
| 11,649,707 | B2 | 5/2023 | Sheng | |
| 11,655,696 | B1 | 5/2023 | Gould et al. | |
| 2014/0262265 | A1* | 9/2014 | Hutchins | E21B 43/267 166/305.1 |
| 2015/0129211 | A1* | 5/2015 | Dusseault | E21B 49/006 166/280.1 |
| 2017/0159416 | A1* | 6/2017 | Sheng | E21B 47/06 |
| 2017/0283688 | A1* | 10/2017 | Valencia | C10G 7/00 |
| 2018/0347328 | A1 | 12/2018 | Aguilera et al. | |
| 2019/0055825 | A1* | 2/2019 | Babcock | E21B 43/166 |
| 2021/0317733 | A1 | 10/2021 | Downey et al. | |
| 2021/0340428 | A1 | 11/2021 | Downey | |

OTHER PUBLICATIONS

Artun, E., Ertekin, T., Watson, R., Miller, B., 2011. "Performance evaluation of cyclic pressure pulsing in a depleted, naturally fractured reservoir with stripper-well production." Petroleum Sci. Technol. 29, 953-965 ("Artun 2011").

Chen, C., Balhoff, B., and Mohanty, K. K., 2014. "Effect of Reservoir Heterogeneity on Primary Recovery and CO, Huff-n-Puff Recovery in Shale-Oil Reservoirs." SPEREE 17(3), 404-413 ("Chen 2014").

Gamadi, T. D., Sheng, J. J., and Soliman, M. Y. 2013. "An Experimental Study of Cyclic Gas Injection to Improve Shale Oil Recovery," paper SPE 166334 presented at the SPE Annual Technical Conference and Exhibition held in New Orleans, La., USA, Sep. 30-Oct. 2 ("Gamadi 2013").

Kurtoglu, B. 2013. "Integrated reservoir characterization and modeling in support of enhanced oil recovery for Bakken," PhD dissertation, Colorado School of Mines, Golden, Colo. ("Kurtoglu 2013").

Meng, X., Yu, Y. Sheng, J. J. Watson, W., and Mody, F. 2015. "An Experimental Study on Huff-n-Puff Gas Injection to Enhance Condensate Recovery in Shale Gas Reservoirs," paper URTeC 2153322 presented at the Unconventional Resources Technology Conference held in San Antonio, Tex., USA, Jul. 20-22 ("Meng 2015").

Monger, T.G., Coma, J. M., 1988. "A laboratory and field evaluation of the CO2 process for light oil recovery." SPE Res. Eng. 3 (4), 1168-1176 ("Monger 1988").

Sheng, J. J. 2015. "Enhanced oil recovery in shale reservoirs by gas injection." Journal of Natural Gas Science and Engineering, 22, 252-259 (invited review) ("Sheng 2015 A").

Sheng, J. J. 2015. "Increase liquid oil production by huff-n-puff of produced gas in shale gas condensate reservoirs." Journal of Unconventional Oil and Gas Resources, 11,19-26 ("Sheng 2015 B").

Sheng, J. J. and Chen, K. 2014. "Evaluation of the EOR Potential of Gas and Water Injection in Shale Oil Reservoirs." Journal of Unconventional Oil and Gas Resources, 5, 1-9 ("Sheng 2014").

Sheng, J. J., Cook, T., Barnes, W., Mody, F., Watson, M., Porter, M., Viswanathan, H. 2015. "Screening of the EOR Potential of a Wolfcamp Shale Oil Reservoir," paper ARMA 15-438 presented at the 49th US Rock Mechanics/Geomechanics Symposium held in San Francisco, Calif.USA, Jun. 28-Jul. 1 ("Sheng 2015 C").

Shoaib, S., Hoffman, B.T., 2009. "CO2 flooding the Elm Coulee field," paper SPE 123176 Presented at the SPE Rocky Mountain Petroleum Technology Conference, Apr. 14-16, Denver, Colo. ("Shoaib 2009").

The Linde Group, Renew Production of Depleted Oil Wells,"CO2 Huff 'n Puff Well Stimulation Increases Oil Recovery".

Wan, T., Meng, X. Sheng, J. J. Watson, M. 2014. "Compositional Modeling of EOR Process in Stimulated Shale Oil Reservoirs by Cyclic Gas Injection," paper SPE 169069 presented at the SPE Improved Oil Recovery Symposium, Apr. 12-16, Tulsa, Okla. ("Wan 2014 A").

Wan, T., Sheng, J. J., and Soliman, M. Y. 2013. "Evaluate EOR Potential in Fractured Shale Oil Reservoirs by Cyclic Gas Injection," paper SPE 168880 or URTeC 1611383 presented at the Unconventional Resources Technology Conference held in Denver, Colo., USA, Aug. 12-14, 2013 ("Wan 2013 B").

Wan, T., Sheng, J. J., and Soliman, M. Y. 2013. "Evaluation of the EOR Potential in Shale Oil Reservoirs by Cyclic Gas Injection," paper SPWLA-D-12-00119 presented at the SPWLA 54th Annual Logging Symposium held in New Orleans, La., Jun. 22-26 ("Wan 2013 A").

Wan, T., Yu, Y., and Sheng, J. J. 2014b. "Comparative Study of Enhanced Oil Recovery Efficiency by CO2 Injection and CO2 Huff-n-Puff in Stimulated Shale Oil Reservoirs," paper 358937 presented at the AIChE annual meeting, Atlanta, Ga., USA, Nov. 16-21 ("Wan 2014 B").

Wan, T., Yu, Y., and Sheng, J. J. 2015. "Experimental and Numerical Study of the EOR Potential in Liquid Rich Shales by Cyclic Gas Injection," submitted to J. of Unconventional Oil and Gas Resources ("Wan 2015").

Wang, X., Luo, P., Er, V, Huang, S. 2010. "Assessment of CO Flooding Potential for Bakken Formation, Saskatchewan," paper SPE-137728-MS presented at the Canadian Unconventional Resources and International Petroleum Conference, Oct. 19-21, Calgary, Alberta, Canada ("Wang 2010").

Yu, W., Lashgari, H., Sepehmoori, K. 2014. "Simulation Study of CO2 Huff-n-Puff Process in Bakken Tight Oil Reservoirs," paper SPE 169575-MS presented at the SPE Western North American and Rocky Mountain Joint Meeting, Apr. 17-18, Denver, Colo. ("Yu 2014").

Yu, Y and Sheng, J. J. 2015. "An Experimental Investigation of the Effect of Pressure Depletion Rate on Oil Recovery from Shale Cores by Cyclic N2 Injection," paper URTeC 2144010 presented at the Unconventional Resources Technology Conference held in San Antonio, Tex., USA, Jul. 20-22 ("Yu 2015").

* cited by examiner

SYSTEM AND METHOD FOR OPTIMIZED PRODUCTION OF HYDROCARBONS FROM SHALE OIL RESERVOIRS VIA CYCLIC INJECTION

RELATED PATENTS AND PATENT APPLICATIONS

This application claims priority to U.S. Provisional Patent Application Ser. No. 63/008,322, filed Apr. 10, 2020, entitled "System And Method For Optimized Production Of Hydrocarbons From Shale Oil Reservoirs Via Cyclic Injection." This patent application is commonly assigned to the Assignee of the present invention and is incorporated herein by reference in its entirety for all purposes.

The present invention generally relates to the production of liquid oil from shale reservoirs. More particularly, the present disclosure relates to an apparatus and method for enabling the optimization of liquid oil production by cyclic injection of hydrocarbon-containing liquids and their recovery, adjustment and reinjection to achieve an improved and optimal oil recovery.

FIELD OF INVENTION

The present invention generally relates to the production of liquid oil from shale reservoirs. More particularly, the present disclosure relates to an apparatus and method for enabling the optimization of liquid oil production by cyclic injection of hydrocarbon-containing liquids and their recovery, adjustment and reinjection to achieve an improved and optimal oil recovery.

BACKGROUND

Shale oil resources have become the focus of the development for the production of crude oil and associated natural gas in the United States over the past 12 years. These shale reservoirs are characterized by thick, continuous deposits of very fine-grained materials with oil and gas interspersed in very small pore spaces in the matrix. Permeability of these shales is very low, and as a result the recovery of the oil and gas therefrom is limited in most cases to only 3-10 percent. Methods for improving or enhancing the recovery of the oil from these shale resources may be derived from commonly employed enhanced recovery processes such as thermal injection, gas injection, liquid injection and chemical injection.

Thermal injection enhanced oil recovery utilizes steam or hot water or hot solvents to extract crude oil from the reservoir. Chemical injection enhanced oil recovery utilizes polymers, surfactant solutions, acids or alkali to extract crude oil from the reservoir. Gas injection enhanced oil recovery utilizes gases, such as carbon dioxide, to enhance the recovery of crude oil from the reservoir, and it is the most common application for enhanced oil recovery, with numerous projects in operation in the United States. Carbon dioxide is used in the process due to its high miscibility in crude oil.

Enhanced oil recovery utilizing these methods has been underway for many years and has resulted in the recovery of millions of barrels of oil. Today, there are over 150 EOR projects underway in the US, producing more than 300,000 barrels of oil per day. These are all projects producing from conventional oil reservoirs, having permeabilities of about 1 millidarcy or more.

The advent of oil production from shale oil and gas reservoirs around 2008 was brought about by efficient horizontal drilling and multiple stage hydraulic fracture stimulation technology development. Because the permeability of these shale oil and gas reservoirs is much lower than 1 millidarcy, primary production via pressure depletion results in the recovery of only a few percent of the oil in place. Enhanced oil recovery via continuous injection of gas does not work. However, some oil and gas producing companies have found that cyclic injection of natural gas can cause significant increased oil recovery, and there are about 250 wells now producing via cyclic injection, also known as "huff and puff."

There have been about 80,000 horizontal shale oil and gas wells drilled in the US as of today. Production from these wells is characterized by high initial flow rates of oil and gas, and a rapid decline in production over the first year, followed by a hyperbolic decline thereafter. Economic production from these wells may continue for 9-15 years. Today, there are over 4000 horizontal shale oil wells whose production has declined to or near an economic limit rate.

Thus, there is a need to provide methods for utilizing these existing wellbores to recover more of the oil remaining in these shale reservoirs. Wan 2013 A proposed cyclic gas injection (huff and puff) to improve oil recovery in shale oil reservoirs. Sheng 2015 reported on several papers published on cyclic gas injection, and used a simulation approach to show that cyclic gas injection may provide the best potential for enhanced recovery (EOR) of oil in shale oil reservoirs. Sheng 2017 demonstrated a method to optimize the recovery of oil via cyclic gas injection by maximizing the injection rate and pressure during the injection period, and by setting the minimum production pressure during production period. However, the method does not provide for optimizing the composition of the injection gases so as to maximize the recovery of the oil remaining in the shale oil reservoir during the cyclic injection process, nor the system required to enable the optimization process.

Therefore, a need remains to improve the cyclic gas injection method to optimize the oil recovery from shale reservoirs.

SUMMARY OF THE INVENTION

The present invention relates to and adds additional invention disclosure to the invention disclosed, described and taught in the Downey '205 application, and more particularly describes the design and operation of apparatus for the recovery of cyclic enhanced recovery hydrocarbon injectants by injecting a hydrocarbon-containing liquid into a shale formation at pressures exceeding the formation fracture pressure, the utilization of data during the production of hydrocarbons during cyclic enhanced recovery in compositional reservoir simulation modeling, and the adjustment of the injectant composition for injection in subsequent cycles of injection, in order to optimize the recovery of oil from a shale oil or shale gas condensate reservoir.

The present invention relates to the production of oil from shale reservoirs. A process has been discovered to optimize oil recovery via cyclic injection or huff and puff method in which certain components of natural gas that are in liquid state at surface injection conditions are injected to achieve an improved and optimal oil recovery.

In embodiments of the current invention, hydrocarbon gases (such as propane, butane, pentane, hexane, carbon dioxide, nitrogen and carbon monoxide and combinations thereof), in liquid or gaseous state at surface injection conditions, are injected. The process increases liquid oil production by cyclic injection and production in shale reservoirs to achieve an optimum oil recovery. The invention features a method to increase recovery of oil from shale reservoirs by a cyclic gas injection process that includes a plurality of injection and production periods.

The process provides a method to further increase recovery of oil from shale reservoirs by cyclic injection of the certain components of natural gas that are in the liquid state at surface injection conditions to pressures that exceed the formation parting pressure, thereby opening new fractures, displacing the injectant into these new fractures, and recovering oil from the areas of the formation exposed by new fractures. A proppant material may be added to the injectant in one or more of the injection cycles to flow into the created fractures, and prop the created fractures to thereby provide for sufficient flow capacity to enable the injectant and oil to flow from the fractures to the wellbore.

The method involves the injection of hydrocarbon-containing fluids in the liquid state at surface injection conditions into the shale oil reservoir wellbore, thereby mitigating the need for compression; however, the method includes the option of injecting hydrocarbon-containing fluids in the liquid and gaseous state at surface injection conditions. The composition of the injection fluids is adjusted in each injection cycle, as may be determined by compositional reservoir simulation modeling, so as to optimize the recovery of the residual oil in the shale oil reservoir.

Hydrocarbon-containing fluids in the liquid state at surface injection conditions are injected into the formation until the pressure at the injection point into the formation exceeds the pressure required to fracture the formation, thereby causing fractures extending from the wellbore to form and open, exposing additional formation surface area to the injectant and providing for additional oil recovery.

The apparatus is designed to recover the injectant and adjust the composition of the injectant to be injected in a subsequent cycle, remove contaminants and corrosive elements, and to produce stabilized oil products and natural gas components. The operation of the apparatus may be monitored and controlled via SCADA (supervisory control and data acquisition) hardware and software. Oil and gas composition, rate and pressure data input and output of the apparatus may be utilized in a compositional reservoir simulation model to predict the composition of hydrocarbons residual in the shale oil or shale gas condensate reservoir, and the simulation model may then be utilized to determine the desired composition of the injectant to be injected in the subsequent injection cycle for optimum recovery of said reservoir hydrocarbons.

The injection cycle time is a period sufficiently long such that the pressure near the wellbore exceeds the formation fracturing pressure during the injection period, and may continue for a period of time so as to open and extend new fractures from the wellbore to provide for optimum recovery of oil from the well.

The production cycle time in the process is the time required for the pressure near the wellbore to reach the set minimum production pressure during the production period. Soaking time may or may not be employed to optimize vaporization, solubilization or mixing of the injectant and reservoir hydrocarbons.

The apparatus may include equipment that is able to ascertain the movement of fluid or rock due to the injection of the injectant above the formation parting pressure, such as microseismic equipment, formation resistivity measurement equipment or surface deformation equipment; and thus the potential amount, location, area and volumes of injectant delivered into the formation and produced therefrom. Reservoir simulation modeling may include integrated geomechanical modeling of the formation and improved analysis of the process.

The injectant may also include a proppant material, particularly of small diameter, to enable the fractures propagated by injecting above the formation parting pressure, to be held open and capable of conducting fluid flow during the production cycles.

In general, in one aspect, the invention features a method for increasing recovery of oil from a shale reservoir utilizing a cyclic injection and production process that comprises a plurality of injection and production periods. The method includes the step (a) of determining a hydrocarbon-containing composition for injection. The hydrocarbon-containing composition is in a liquid state at surface injection conditions. The method further includes the step (b) of determining the shale reservoir fracture pressure at which the hydrocarbon-containing composition can cause the shale reservoir to fracture. The method further includes the step (c) of determining a maximum injection rate and a maximum injection pressure in a well to be utilized during a plurality of injection and production periods. The maximum injection pressure results in a near wellbore reservoir pressure that is at least the shale reservoir fracture pressure. The method further includes the step (d) of injecting the hydrocarbon-containing composition into the shale reservoir so as to create fractures and displace the hydrocarbon-containing composition into the created fractures. The method further includes the step (e) of determining a maximum production rate of gases and liquids from the well and the minimum production pressure during the plurality of injection and production periods. The method further includes the step (f) of injecting the hydrocarbon-containing composition during the injection period for a period of time such that the near wellbore reservoir pressure of the well reaches at least the shale reservoir fracture pressure, whereby, while continuing to inject the hydrocarbon-containing composition, the near wellbore reservoir pressure is maintained at or above the shale reservoir fracture pressure for a pre-determined period of time of injection period. The method further includes the step (g) of producing the well to obtain hydrocarbon fluids during the production period for a period of time such that the pressure at the wellbore reaches the determined minimum production pressure. The method further includes the step (h) of at or during the production period, assessing the composition of the hydrocarbon fluids produced during the step of producing the well and utilizing a compositional reservoir simulation model to determine the composition of residual hydrocarbons in the shale reservoir. The method further includes the step (i) of utilizing a hydrocarbon processing apparatus designed so as to recover the hydrocarbon containing composition for injection from the produced hydrocarbon fluids. The hydrogen processing apparatus includes equipment selected from a group consisting of stage separators, compressors, refrigeration units, joule-thompson units, fractionation and stabilization units; chemical additives storage and injection pumps; gauges, sensors, controls, SCADA equipment, heat exchangers, coolers, vessels, and combinations thereof. The method further includes the step (j) of processing the produced hydrocarbon fluids at the surface with the hydrocarbon processing apparatus to remove methane and ethane gases and hydrocarbons containing hexanes and greater molecular weight. The method further includes the step (k) of adjusting the composition of the hydrocarbon-containing injection fluids utilizing the hydrocarbon processing apparatus to determine an adjusted hydrocarbon-containing composition for injection. The method further includes the step (l) of repeating steps (b) through (k) utilizing the adjusted hydrocarbon-containing composition.

Implementations of the invention can include one or more of the following features:

The injection and production process can be not including a shut-in or soaking step between the steps of injection and production.

The injection and production process can include a shut-in or soaking step between the steps of injection and production.

The steps of injection can include injection of the hydrocarbon-containing fluid that includes a fluid selected from a group consisting of ethane, propane, butane, heptane, hexane, carbon dioxide, and combinations thereof.

The steps of injection can include injection of the hydrocarbon-containing fluid that further includes a gaseous substance selected from a group selected from methane, ethane, carbon monoxide, and combinations thereof.

The step of injection can include the injection of the hydrocarbon-containing liquid that comprises a materials selected from a group consisting of liquid surfactants, nanosurfactants, nanoparticles, and combinations thereof.

The step of utilizing the compositional reservoir simulation model can include utilizing the compositional reservoir simulation model to optimize the recovery of residual crude oil.

The step of determining the maximum injection rate and maximum injection pressure during the injection periods can be determined based upon at least one of surface facilities capacities, reservoir conditions, wellbore conditions, and operation constraints.

The step of determining the maximum production rate and minimum production pressure during the production periods can be determined based upon at least one of surface facilities capacities, reservoir conditions, wellbore conditions, and operation constraints.

The hydrocarbon-containing composition for injection can be in a liquid state at surface injection conditions and can be injected at a temperature of at most 50° F.

The hydrocarbon processing apparatus can further include hydrogen sulfide removal equipment, carbon dioxide removal equipment, or both.

The method can further include determining or estimating the extent of formation fracturing during the injection of the hydrocarbon-containing liquid and its location. The step of determination or estimated the extent of formation fractioning can be performed utilizing equipment selected from a group consisting of microseismic measurement equipment, formation resistivity measurement equipment, surface deformation equipment, and combinations thereof.

A proppant material can be injected with the hydrocarbon-containing liquid. The proppant can include a solid selected from a group consisting of sand, ceramic, bauxite, petcoke, polymer, and combinations thereof.

DESCRIPTION OF DRAWINGS

For better understanding of the present invention, and the advantages thereof, reference is made to the following descriptions taken in conjunction with the accompanying drawings.

DETAILED DESCRIPTION

Figure 1:
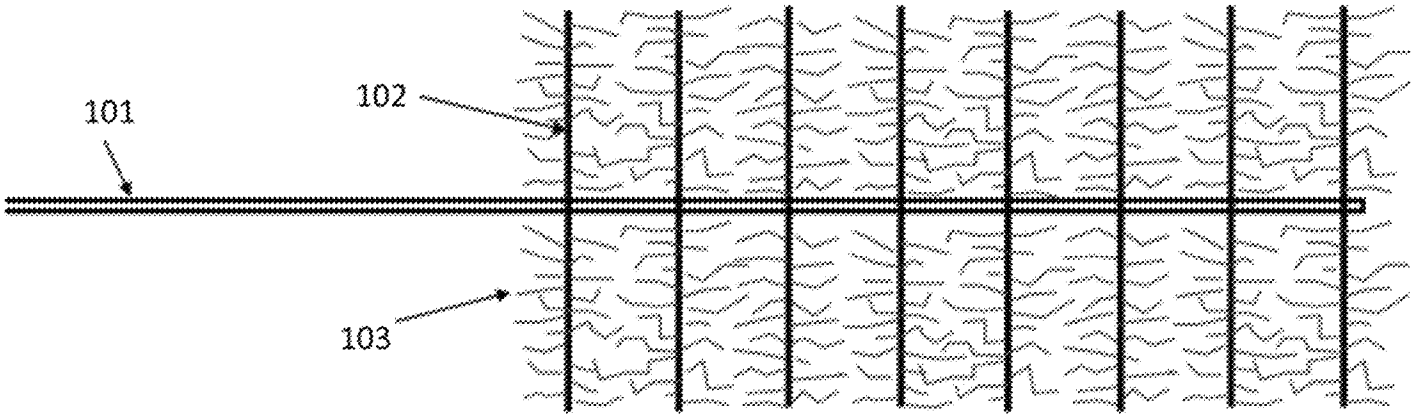
FIG. 1 is a diagram showing a horizontal wellbore completed in a shale oil producing formation with multiple fractures extending from the wellbore to the formation and illustrating how injection above the formation parting pressure may propagate additional fractures in the formation surrounding the wellbore.

The present invention generally relates to the production of liquid oil from shale reservoirs. More particularly, the present disclosure relates to an apparatus and methods and processes of its design and operation for the optimization of liquid oil production by cyclic injection of hydrocarbon-containing liquids to pressures exceeding the pressure at which the producing formation begins to fracture, exposing additional formation surface area to the injectant; and their recovery, adjustment and reinjection to achieve an improved and optimal oil recovery.

Recovery of oil via cyclic injection and production occurs from surface areas of a shale oil formation that are contacted by the injection of the hydrocarbon-containing liquids. These surface areas of contact are generated by the hydraulic fracture stimulation treatment conducted in the well upon its initial completion. During the hydraulic fracture stimulation treatment, a proppant material, such as sand, is pumped with the hydraulic fracturing fluid and travels into the generated fractures. The proppant acts to keep the fractured surface area separated, maintaining fluid conductivity so that the hydrocarbons flowing from the matrix to the surface of the fractures may flow through the fractures and into the wellbore.

Many shale oil formations have varying stress regimes, and most have regimes where there is a maximum and a minimum principal stress direction. To optimize the recovery of oil from horizontal wellbores drilled into shale oil formations and completed with multiple stage hydraulic fracture stimulation treatments, well laterals are generally oriented in the direction of the minimum principal stress, so that the fractures will extend in the direction of the maximum principal stress, and perpendicular to the lateral wellbore.

During the fracture stimulation treatment, the fluid and proppant is pumped into the formation into one or more sets of perforations or openings from the casing into the formation, and a fracture is created and extends from the wellbore in a direction generally perpendicular to the wellbore. During the fracturing process, compressive forces act on the formation in the minimum principal stress direction, and can cause a change in the stress orientation of that portion of the formation between and around the fracture stages. During subsequent production from the well, the stresses in those areas of the formation between the fracture stages may further change and change orientation, as hydrocarbons are produced, the formation fluid pressure declines, and the effective stress on the formation increases. These stress changes may be analyzed using a geomechanical model of the formation, and can be further confirmed and calibrated via microseismic data analysis, which is collected during the hydraulic fracture stimulation treatment.

During cyclic injection of hydrocarbon-containing liquids and production of oil and the injected hydrocarbon-containing liquids, at maximum injection pressures that are less than the pressure required to fracture the formation, the hydraulic conductivity of the propped surface area may be approximately maintained.

If the maximum injection pressure during cyclic injection of hydrocarbon-containing liquids exceeds that pressure required to fracture the formation, additional fractures may be formed, in addition to and extending from the initial fracture or fractures created by the fracture stimulation treatment conducted during the initial well completion. These additional fractures may, depending upon the stress of the rock in the affected area, extend in several directions, and may consist of numerous fractures of various lengths and widths. The surface area of these fractures may be significant, exceeding the surface area of the original fracture resulting from initial completion fracture stimulation treatment. And, with each subsequent cyclic injection to pressure above the pressure required to fracture the formation, additional fractures may be formed, resulting in the creation of additional surface area.

Injection of hydrocarbon-containing liquids at pressures that exceed that pressure required to fracture the formation could extend the fracture resulting from initial completion fracture stimulation treatment, rather than creating new fractures in the region between and near the fracture stages, however, limiting the rate and injection volumes in the cyclic injection of hydrocarbon-containing liquids may limit such initial fracture propagation.

Optimized Production of Hydrocarbons Via Cyclic Injection

In embodiments of the current invention, the injection gas composition, maximum injection rate and maximum injection pressure during the injection period, and the maximum oil and gas production rates and minimum production during the production period, are determined by reservoir oil composition, reservoir conditions, operation constraints and surface facilities capacity. The injection period is the time required for the pressure near the wellbore to reach the desired maximum injection pressure, which is a pressure above the formation parting pressure, the pressure required to cause the formation to fracture, allowing the injectant to be forced into these new fractures and contact formation oil at these new fracture faces and in the formation matrix adjacent to these new fracture faces, as shown in FIG. 1. In FIG. 1, the wellbore has a horizontal section 101. Fractures 102 are the fractures created during initial well completion hydraulic fracture stimulation treatment. Fractures 103 are fractures that are created by cyclic injection of hydrocarbon-containing liquids that exceeded the formation fracture pressure.

The production period is the time required for the pressure near the wellbore to reach the set minimum production pressure. The injection gas composition is that combination of natural gas and other gas components that compositional reservoir simulation modeling, coupled with geomechanical modeling of the stresses and fracture propagation in the formation that may be determined by microseismic or other means, indicates will result in optimum or highly beneficial recovery of oil during the injection and production cycle. In some embodiments, the well may be shut in following the injection period to provide a soaking time for the injected liquids to mix with the reservoir oil. The benefits of soaking time may not compensate the loss in production due to the time lost in the soaking period, as a result the soaking step may be eliminated during the cyclic gas injection process in shale oil reservoirs.

In embodiments of the current invention, the injection of natural gas and other gases components in the liquid or near-liquid state at surface injection conditions mitigates the need for high volume, high pressure natural gas compression equipment, and high pressure flowlines, valves, fittings and wellheads; and the need to purchase natural gas. The natural gas and other gases components in the liquid or near-liquid state at surface injection conditions can be trucked or flowed to the well location, stored at or near the well location and rapidly pumped into the well at the desired rate and injection pressure using conventional liquid pumping equipment.

Figure 2:
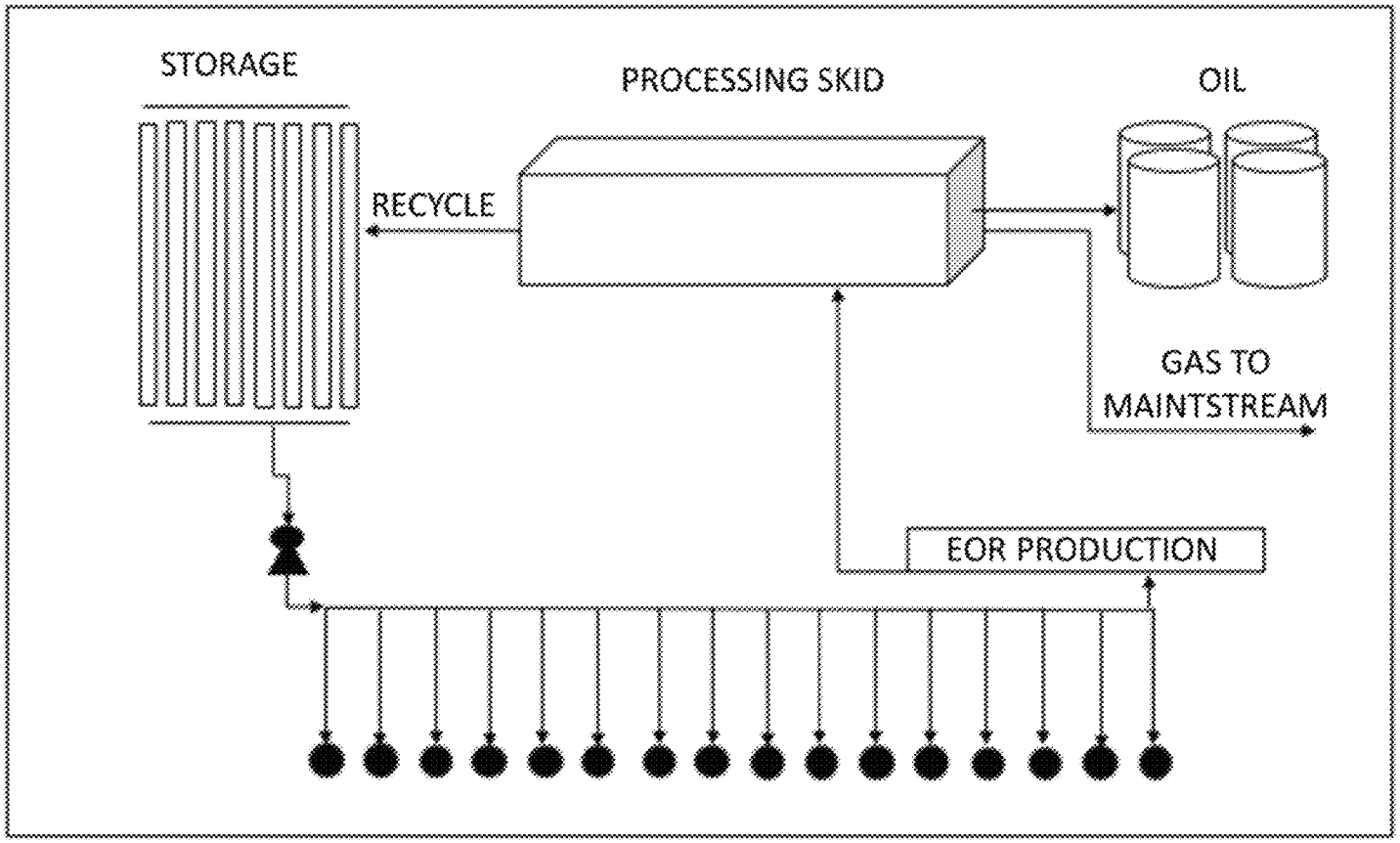
FIG. 2 is a schematic of the general surface equipment used in the cyclic hydrocarbon injection enhanced recovery process described herein.
Figure 3:
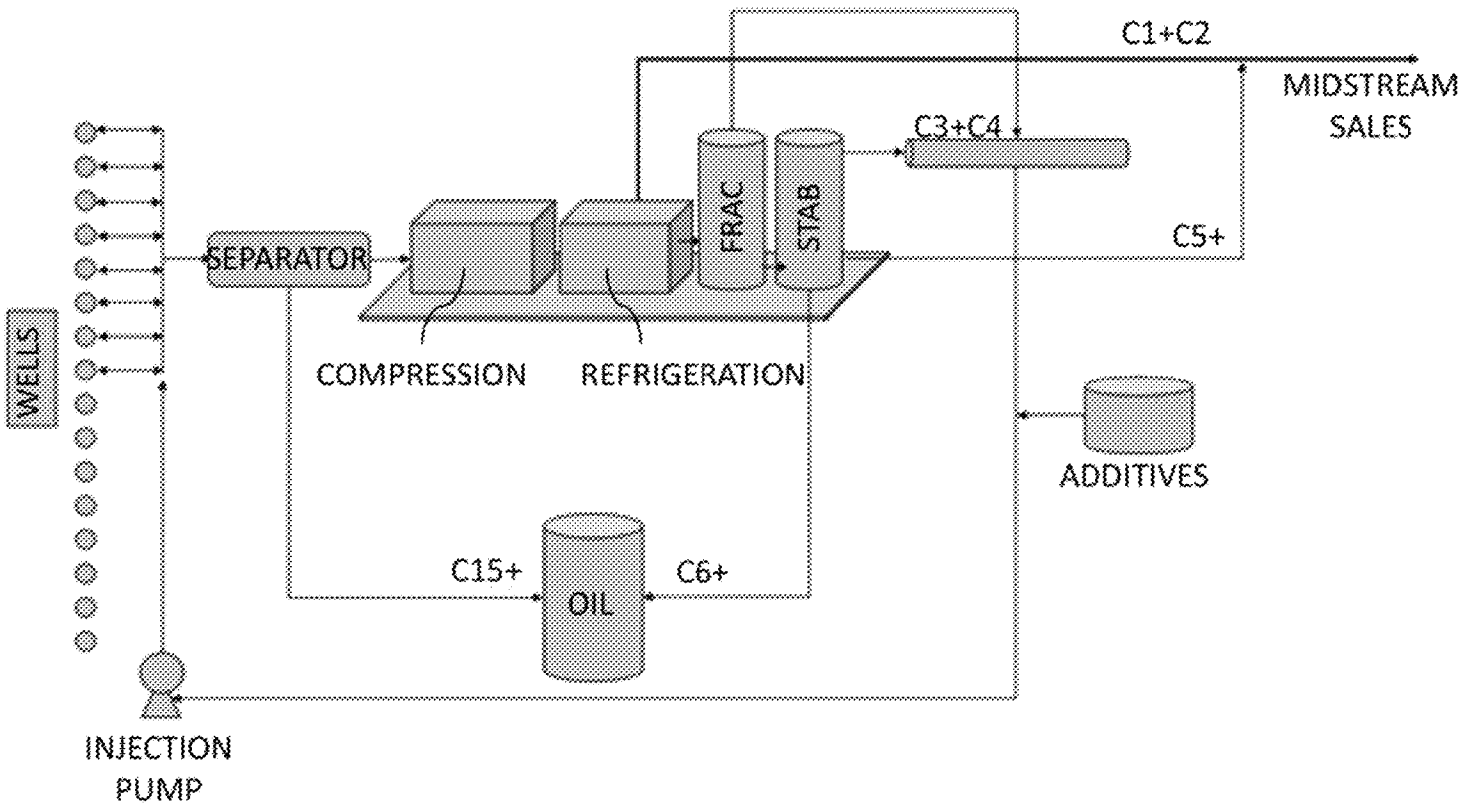
FIG. 3 is a flow diagram showing the general equipment apparatus used for separation of the produced oil and gas and injectant and adjustment of the composition of the produced injectant, addition of additives to the injectant and the process flow of the various hydrocarbon components.

In embodiments of the current invention, and as shown in FIGS. 2-3, the production of oil and injected natural gases and other gases components are directed through equipment at or near the well location to separate the oil, gas containing methane and ethane from the injected natural gas, and other gases components in the liquid or near-liquid state at surface injection conditions. The recovered natural gas and other gases components in the liquid or near-liquid state at surface injection conditions are then accumulated to a desired volume and reinjected in subsequent cycles of injection and production.

In embodiments of the current invention, the equipment utilized to separate produced oil and gas from the injectant, and to adjust the composition of the produced injectant for storage and reinjected in subsequent cycles of injection and production, is described herein and may be designed as an integrated package that may be fully monitored and controlled.

Figure 4:
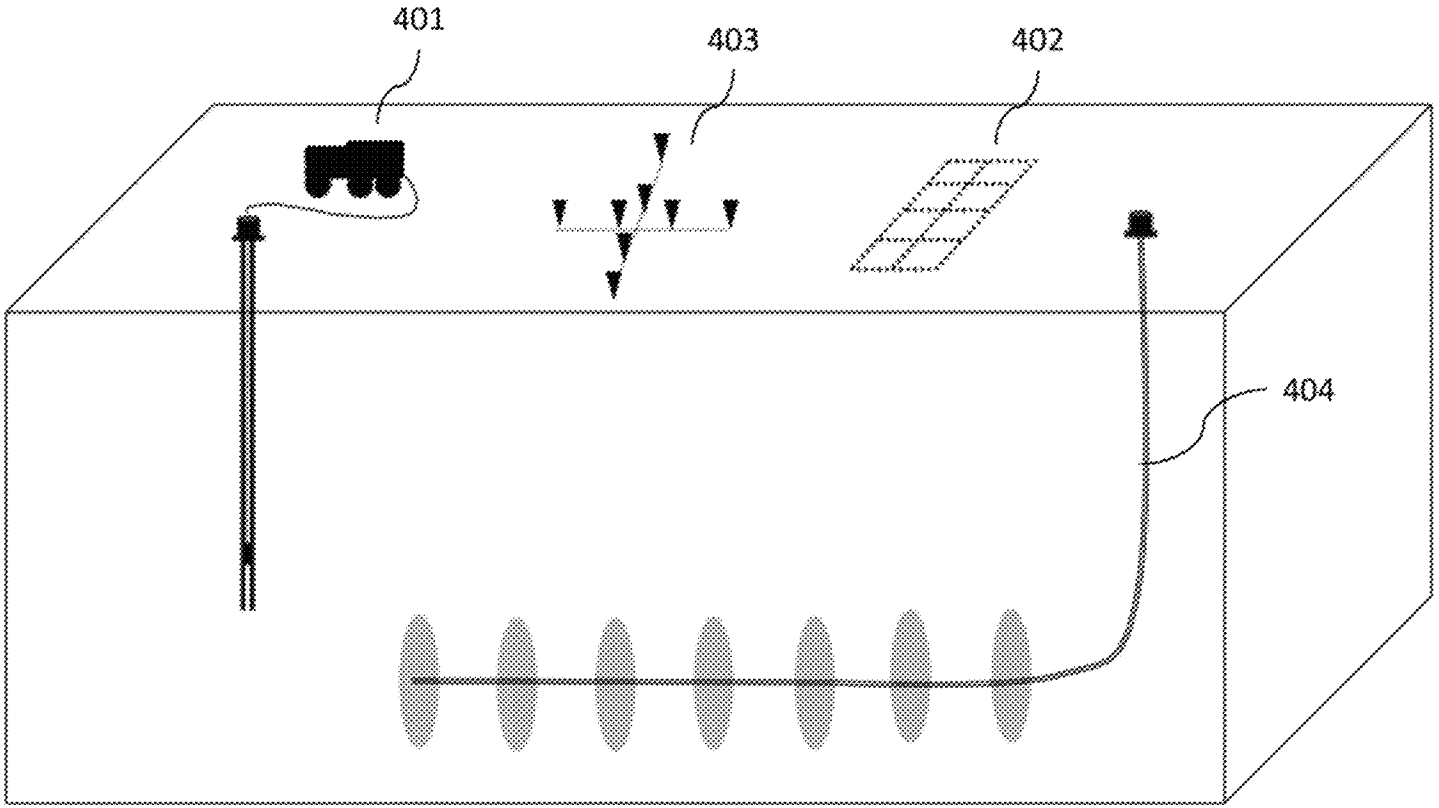
FIG. 4 is an illustration showing a method for the geomechanical monitoring of the process described herein.

In embodiments of the current invention, and as shown in FIG. 4, the equipment utilized to monitor the flow of injectant into the formation and the propagation of fractures resulting from injection above the formation parting pressure, is described herein and may be designed as an integrated package that may be fully monitored and controlled. Such equipment includes microseismic measurement equipment 401, formation resistivity measurement equipment 402, and surface deformation equipment 403 (such as Earth tilt measuring equipment). Wellbore 404 is shown with a portion that is horizontal through the reservoir.

Figure 5:
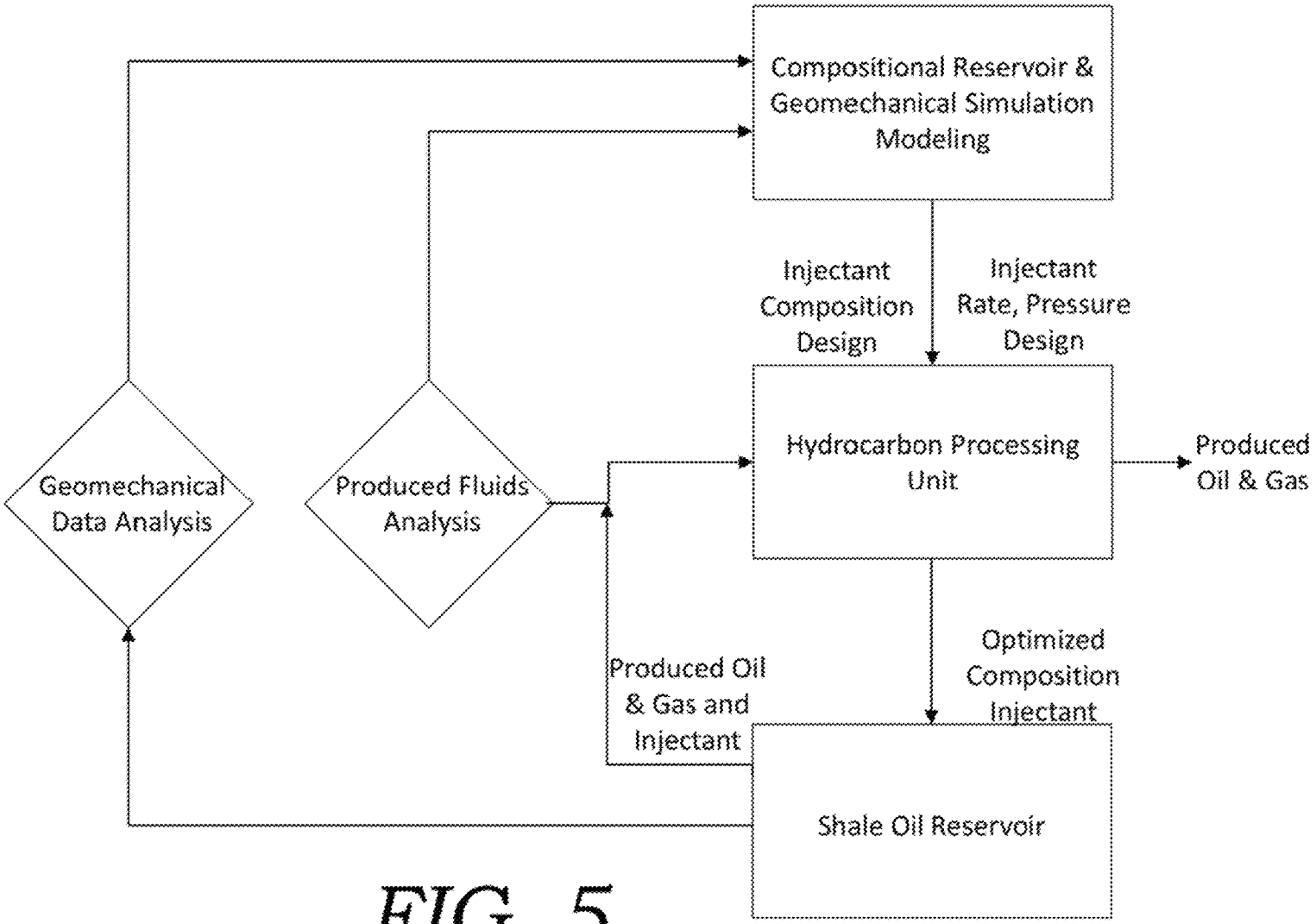
FIG. 5 is a diagram showing the data flow enabling the operation of the equipment apparatus for the optimization of the cyclic hydrocarbon injection enhanced recovery process described herein.
Figure 6:
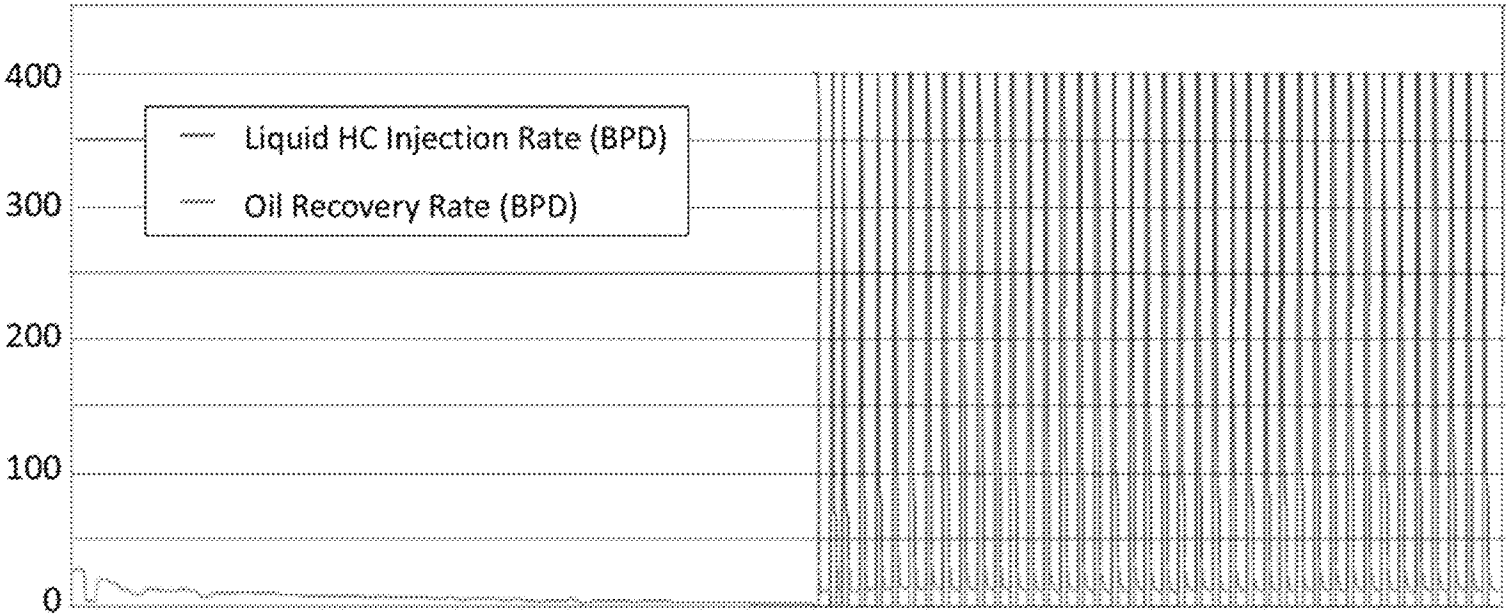
FIG. 6 is a graph depicting the cyclic injection and production curve of the described shale oil enhanced recovery process.

In embodiments of the current invention, the production of oil and injected natural gases and other gases components are analyzed for composition and a compositional reservoir simulation model, coupled to or integrated with a geomechanical rock properties model, may be utilized to assess the composition of the oil in the reservoir. The compositional reservoir simulation model may then be utilized to determine the composition of natural gas and other gases components in the liquid or near-liquid state at surface injection conditions that will optimize the recovery of oil in the reservoir, and that composition may be so adjusted, and injected. This process is depicted in FIG. 5.

In embodiments of the current invention, the equipment package can include a two-stage or three-stage separator or separators, to separate produced liquid crude oil, liquid water, and natural gas produced from a well or multiple wells on one or more multiwell pads, a compressor to compress the natural gas exiting the two-stage or three-stage separator or separators; a refrigeration unit, or a joule-thompson unit, to separate methane and ethane from the natural gas; a fractionation and stabilization unit to separate propane and butane and other desired components from the natural gas, a stabilization unit to separate hexane and heavier natural gas component molecules; chemical additives storage and injection pump or pumps; gauges, sensors, controls and SCADA equipment to provide for data acquisition, data storage, transmission, processing and control; along with heat exchangers, coolers and related vessels.

In embodiments of the current invention, the composition of natural gas and other gases components in the liquid or near-liquid state at surface injection conditions for injection may be amended to include nanoparticles, surfactants, nano-surfactants and nanoparticle-containing surfactants, which may improve oil recovery by lowering the interfacial tension of oil and the shale matrix.

In embodiments of the current invention, the composition of natural gas and other gases components in the liquid or near-liquid state at surface injection conditions for injection may be amended to include proppant materials, such as sand, ceramic spheres, composite beads, or other solids, of appropriate size, that may flow with the injectant into the fractures propagated by injecting above the formation parting pressure, and enable the fractures to be held open and capable of conducting fluid flow during the production cycles.

In embodiments of the current invention, the composition of natural gas and other gases components in the liquid or near-liquid state at surface injection conditions may be amended to include carbon dioxide, carbon monoxide, ethane, or nitrogen in order to improve the recovery of oil.

By way of example, an injectant (such as a C3/C4 injectant) is injected into the formation and the pressure increased to a point above the formation fracture pressure, at which point the formation will begin to crack, thereby exposing the injectant to new fracture surfaces. Injection would thereafter be continued injecting at or near this pressure (i.e., at or above the formation fracture pressure) for some period of time so as to continue propagating additional surface area and contacting it with the injectant, until such time that microseismic or other monitoring process indicate that sufficient fractures have been generated, or that the fractures being generating are propagating away from the desired area, or have stopped propagating. At that point, injection is stopped, with thereafter (with or without a soak period), production period would begin and fluids from the well would be produced. This huff and puff process would then be repeated, with adjustments being made to the injectant (such as its composition), injection rate, injection pressures, length of injection period, producing rate, production pressures, length of production period, etc.

The amount of oil and other hydrocarbons recovered by shale oil huff and puff EOR is proportional to the amount of surface area that is exposed to the injectant fluid. This method takes advantage of the rock stress reorientation that occurred when the well was fracture stimulated during initial completion, and that continued as the well was produced, to generate additional fractures and surface area so that those additional surface areas can be contacted by the injectant, to recover more oil. In some shale plays, it is believed that the present invention will increase the amount of oil recovered by this method to 4 to 10 times of the primary EUR.

Compositional Reservoir Simulation with Geomechanics Model

A compositional reservoir simulation mathematical model that fully incorporates formation geomechanics may be utilized to forecast the injection of hydrocarbon-containing liquids and the production of oi, gas and the injected hydrocarbon-containing liquids, as well as the characteristics of the formation, such as formation stresses, permeability, porosity, and fracture fluid conductivity.

Shale formation characteristics such as formation stresses in the X, Y and Z directions, permeability to injected and produced fluids, porosity, and fracture fluid conductivity can be expected to change significantly during each cycle of injection and production, and these characteristics may change further as additional fractures are created during each injection cycle. To model these various formation characteristics, microseismic data may be collected during several of the injection and production cycles to ascertain the location and magnitude of the shear fractures that occur in the formation when fluid is injected into the formation above the fracture pressure, and the fluid movement into the areas of the formation where these fractures are being propagated. This data is utilized in the compositional reservoir simulation model, along with other data, to model the change in formation surface area caused by the generation, extension and growth of fractures during the injection of hydrocarbon-containing liquids and the production of oil during the flowback portion of the cyclic process.

Geomechanics data to be collected may include microseismic, equipment, formation resistivity measurement equipment or surface deformation equipment, or other means. Microseismic data may be collected from geophones placed in the wellbore or on the surface above or near the wellbore undergoing the cyclic shale oil EOR process, or in an adjacent or nearby wellbore, and the data may be collected and processed in a continuous or intermittent fashion. Formation resistivity measurement equipment may be used to measure changes in resistivity of the formation rock due to the cyclic injection of hydrocarbon-containing liquids and the production of hydrocarbons and the hydrocarbon-containing liquids injectant. Deformation measurement equipment utilizes tiltmeters that measure the change in slope of the surface or other reference point due to the injection of hydrocarbon-containing liquids and the production of hydrocarbons and the hydrocarbon-containing liquids injectant. This data, is used along with other rock properties data, such as Young's modulus, Poisson's ratio, Biot coefficient, density, and tensile and compressive strength in developing a comprehensive geomechanical reservoir simulation model of the shale oil reservoir.

PVT data from wells completed in and producing from a shale oil formation may be utilized to construct an Equation of State, and the Equation of State may then be incorporated into a compositional reservoir simulation model that includes a comprehensive geomechanical reservoir simulation model of the shale oil reservoir.

The compositional reservoir simulation with geomechanics model can then be utilized along with well completion and production data to obtain a production and pressure history match. Once a match on historical oil, gas and water production and producing pressure is obtained, the match parameters can then be utilized to evaluate well performance and oil recovery under cyclic injection of hydrocarbon-containing liquids under varying operating conditions including injection at surface injection conditions to pressures that exceed the formation parting pressure, thereby opening new fractures, displacing the injectant into these new fractures, and recovering oil from the areas of the formation exposed to the injectant by new fractures. Recovery of oil via cyclic injection has been shown to be a function of the formation surface area contacted by the injectant [Wan 2013 B].

During cyclic injection of hydrocarbon-containing liquid, a proppant material, such as sand, ceramic, bauxite, petcoke or polymer may be added to the injectant stream and injected into formation, flowing with the injectant into the fractures created by injecting above formation parting pressure, thereby enabling fluid conductivity in the fractures to be maintained during the production cycle of the hydrocarbon-containing liquid and formation oil and gas. The proppant may be injected at varying concentrations, proppant diameters, and during certain selected injection cycles as may be determined by observation of well performance, geomechanical response or other indicators, such as microseismic, formation resistivity or surface deformation.

There are several processes that cause high oil recovery via cyclic injection of propane and butane. During injection, the matrix oil is mobilized by miscibility with the injectant at the matrix/fracture interface due to solvent extraction, which causes countercurrent flow of oil from the matrix. This mechanism is called advection, and is dependent upon pressure and gravity gradients. Oil swelling during injectant exposure causes a reduction in the hydrocarbon density, viscosity and interfacial tension. Injectant/hydrocarbon interaction, miscibility and oil mobility is likewise increased. Gas relative permeability hysteresis improves oil mobilization, as gas relative permeability is lower during the production period than during the injection period. Another mechanism, molecular-diffusion mass transport, complements the advection process and is driven by the chemical potential gradient of the molecular species. In summary, the primary mechanisms that drive the extraction of oil from tight matrix during hydrocarbon gas liquid cyclic injection EOR are repressurization solution gas drive, viscosity and interfacial tension reduction via oil swelling, wettability alteration and relative permeability hysteresis. [Alharthy 2018].

Cyclic injection EOR of rich natural gas hydrocarbons such as propane and butane require their acquisition, transport to the wellsite, storage, and injection using a high pressure pump, such as a triplex pump, configured for such application. The cost of the rich natural gas hydrocarbons such as propane and butane may be a considerable expense to the EOR project that may substantially reduce or preclude its economic viability. However, this expense may be almost completely mitigated by recovering the injectants in a reprocessing equipment package situated on the well pad or in the vicinity of the well, separating them from the produced oil and gas during the puff or production cycle, and storing them for subsequent reinjection during the huff or injection cycle. The reprocessing equipment package may include first stage separation of oil and water liquids, compression, if needed, refrigeration, dehydration and fractionation. The injectant may thereby be completely recovered, with produced oil directed to storage and all gaseous produced hydrocarbons excluding the desired injectant composition directed to sales or midstream processing.

The cyclic EOR process may be optimized by measurement of the injectant and produced fluids composition during each injection and production cycle, running a compositional reservoir simulation model with geomechanics to determine the residual oil composition in the reservoir at the end of each cycle, the extent and location of fracture surface area and volume generated by the injection, and adjusting the composition and volume of the injectant in order to optimize the oil recovery in the subsequent injection and production cycle. The compositional reservoir simulation modeling with geomechanics conducted during the cyclic injection may also determine the injection rate, injection volume, period and pressure; soak time, and production rate, period and pressure in each subsequent injection and production cycle in order to optimize the recovery of oil from the shale reservoir.

The injectant composition may include the addition of liquid surfactants, nano-surfactants, or nanoparticles to reduce interfacial tension, wettability and viscosity. The compositional reservoir simulation modeling may also be conducted so as to mathematically account for changes to interfacial tension, wettability and viscosity by these additives, and thereby further optimize the recovery of oil from the shale reservoir.

PATENTS/PATENT APPLICATIONS AND PUBLICATIONS

The following patents/patent applications and publications further relate to the present invention:

U.S. Pat. No. 9,932,808, "Liquid Oil Production from Shale Gas Condensate Reservoirs," applicant Texas Tech University System, Lubbock, Tex. and inventor James J. Sheng, Lubbock, Tex.

United States Patent Application Publ. No. 2017/0159416, "Method for Optimization of Huff-N-Puff Gas Injection in Shale Reservoirs," applicant Texas Tech University System, Lubbock, Tex. and inventor James J. Sheng, Lubbock, Tex.

United States Patent Application Publ. No. 2018/0347328, "Method for Recovering Hydrocarbons from Low Permeability Formations," applicants Aguilera, Fragoso, Guicheng, Jing, and Nexen Energy, Calgary, Canada.

Alharthy, N., Teklu, T, Kazemi, H., Graves, R., Hawthorne, S., Branuberger, J., and Kurtoglu, B., 2018. "Enhanced Oil Recovery in Liquid-Rich Shale Reservoirs: Laboratory to Field." *SPE* 175034 ("Alharthy 2018").

Artun, E., Ertekin, T., Watson, R., Miller, B., 2011. "Performance evaluation of cyclic pressure pulsing in a depleted, naturally fractured reservoir with stripper-well production." *Petroleum Sci. Technol.* 29, 953-965 ("Artun 2011").

Chen, C., Balhoff, B., and Mohanty, K. K., 2014. "Effect of Reservoir Heterogeneity on Primary Recovery and CO, Huff-n-Puff Recovery in Shale-Oil Reservoirs." *SPEREE* 17(3), 404-413 ("Chen 2014").

Gamadi, T. D., Sheng, J. J., and Soliman, M. Y. 2013. "An Experimental Study of Cyclic Gas Injection to Improve Shale Oil Recovery," paper *SPE* 166334 presented at the SPE Annual Technical Conference and Exhibition held in New Orleans, La., USA, 30 September-2 October ("Gamadi 2013").

Kurtoglu, B. 2013. "Integrated reservoir characterization and modeling in support of enhanced oil recovery for Bakken," PhD dissertation, Colorado School of Mines, Golden, Colo. ("Kurtoglu 2013").

Meng, X., Yu, Y. Sheng, J. J. Watson, W., and Mody, F. 2015. "An Experimental Study on Huff-n-Puff Gas Injection to Enhance Condensate Recovery in Shale Gas Reservoirs," paper *URTeC* 2153322 presented at the Unconventional Resources Technology Conference held in San Antonio, Tex., USA, 20-22 July ("Meng 2015").

Monger, T. G., Coma, J. M., 1988. "A laboratory and field evaluation of the $CO_2$ process for light oil recovery." *SPE Res. Eng.* 3 (4), 1168-1176 ("Monger 1988").

Sheng, J. J. and Chen, K. 2014. "Evaluation of the EOR Potential of Gas and Water Injection in Shale Oil Reservoirs." *Journal of Unconventional Oil and Gas Resources,* 5, 1-9 ("Sheng 2014").

Sheng, J. J. 2015. "Enhanced oil recovery in shale reservoirs by gas injection." *Journal of Natural Gas Science and Engineering,* 22, 252-259 (invited review) ("Sheng 2015 A").

Sheng, J. J. 2015. "Increase liquid oil production by huff-n-puff of produced gas in shale gas condensate reservoirs." *Journal of Unconventional Oil and Gas Resources,* 11, 19-26 ("Sheng 2015 B").

Sheng, J. J., Cook, T., Barnes, W., Mody, F., Watson, M., Porter, M., Viswanathan, H. 2015. "Screening of the EOR Potential of a Wolfcamp Shale Oil Reservoir," paper ARMA 15-438 presented at the 49th US Rock Mechanics/Geomechanics Symposium held in San Francisco, Calif. USA, 28 June-1 July ("Sheng 2015 C").

Shoaib, S., Hoffman, B. T., 2009. "$CO_2$ flooding the Elm Coulee field," paper SPE 123176 Presented at the SPE Rocky Mountain Petroleum Technology Conference, 14-16 April, Denver, Colo. ("Shoaib 2009").

Wan, T., Sheng, J. J., and Soliman, M. Y. 2013. "Evaluation of the EOR Potential in Shale Oil Reservoirs by Cyclic Gas Injection," paper SPWLA-D-12-00119 presented at the SPWLA 54th Annual Logging Symposium held in New Orleans, La., 22-26 June ("Wan 2013 A").

Wan, T., Sheng, J. J., and Soliman, M. Y. 2013. "Evaluation of the EOR Potential in Fractured Shale Oil Reservoirs by Cyclic Gas Injection," paper SPE 168880 or URTeC 1611383 presented at the Unconventional Resources Technology Conference held in Denver, Colo., USA, 12-14 Aug. 2013 ("Wan 2013 B").

Wan, T., Meng, X. Sheng, J. J. Watson, M. 2014. "Compositional Modeling of EOR Process in Stimulated Shale Oil Reservoirs by Cyclic Gas Injection," paper SPE 169069 presented at the SPE Improved Oil Recovery Symposium, 12-16 April, Tulsa, Okla. ("Wan 2014 A").

Wan, T., Yu, Y., and Sheng, J. J. 2014b. "Comparative Study of Enhanced Oil Recovery Efficiency by $CO_2$ Injection and CO2 Huff-n-Puff in Stimulated Shale Oil Reservoirs," paper 358937 presented at the AIChE annual meeting, Atlanta, Ga., USA, 16-21 November ("Wan 2014 B").

Wan, T., Yu, Y., and Sheng, J. J. 2015. "Experimental and Numerical Study of the EOR Potential in Liquid Rich Shales by Cyclic Gas Injection," submitted to *J. of Unconventional Oil and Gas Resources* ("Wan 2015").

Wang, X., Luo, P., Er, V, Huang, S. 2010. "Assessment of CO Flooding Potential for Bakken Formation, Saskatchewan," paper SPE-137728-MS presented at the Canadian Unconventional Resources and International Petroleum Conference, 19-21 October, Calgary, Alberta, Canada ("Wang 2010").

Yu, W., Lashgari, H., Sepehrnoori, K. 2014. "Simulation Study of $CO_2$ Huff-n-Puff Process in Bakken Tight Oil Reservoirs," paper SPE 169575-MS presented at the SPE Western North American and Rocky Mountain Joint Meeting, 17-18 April, Denver, Colo. ("Yu 2014").

Yu, Y and Sheng, J. J. 2015. "An Experimental Investigation of the Effect of Pressure Depletion Rate on Oil Recovery from Shale Cores by Cyclic N2 Injection," paper URTeC 2144010 presented at the Unconventional Resources Technology Conference held in San Antonio, Tex., USA, 20-22 July ("Yu 2015").

The disclosures of all patents, patent applications, and publications cited herein are hereby incorporated herein by reference in their entirety, to the extent that they provide exemplary, procedural, or other details Supplementary to those set forth herein.

While embodiments of the invention have been shown and described, modifications thereof can be made by one skilled in the art without departing from the spirit and teachings of the invention. The embodiments described and the examples provided herein are exemplary only, and are not intended to be limiting. Many variations and modifications of the invention disclosed herein are possible and are within the scope of the invention. The scope of protection is not limited by the description set out above, but is only limited by the claims which follow, that scope including all equivalents of the subject matter of the claims.

Amounts and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of approximately 1 to approximately 4.5 should be interpreted to include not only the explicitly recited limits of 1 to approximately 4.5, but also to include individual numerals such as 2, 3, 4, and sub-ranges such as 1 to 3, 2 to 4, etc. The same principle applies to ranges reciting only one numerical value, such as "less than approximately 4.5," which should be interpreted to include all of the above-recited values and ranges. Further, such an interpretation should apply regardless of the breadth of the range or the characteristic being described.

Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are now described.

Following long-standing patent law convention, the terms "a" and "an" mean "one or more" when used in this application, including the claims.

Unless otherwise indicated, all numbers expressing quantities of ingredients, reaction conditions, and so forth used in the specification and claims are to be understood as being modified in all instances by the term "about." Accordingly, unless indicated to the contrary, the numerical parameters set forth in this specification and attached claims are approximations that can vary depending upon the desired properties sought to be obtained by the presently disclosed subject matter.

As used herein, the term "about" and "substantially" when referring to a value or to an amount of mass, weight, time, volume, concentration or percentage is meant to encompass variations of in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed method.

As used herein, the term "and/or" when used in the context of a listing of entities, refers to the entities being present singly or in combination. Thus, for example, the phrase "A, B, C, and/or D" includes A, B, C, and D individually, but also includes any and all combinations and subcombinations of A, B, C, and D.

What is claimed is:

1. A method for increasing recovery of oil from a shale reservoir utilizing a cyclic injection and production process, wherein the cyclic injection and production process (1) comprises a plurality of injection periods and a plurality of production periods, and (2) cycles alternatively between an injection period in the plurality of the injection periods and a production period in the plurality of production periods, wherein the method comprises steps of:

(a) determining a composition of a hydrocarbon-containing composition for injection, wherein the hydrocarbon-containing composition is in a liquid state at surface injection conditions;

(b) determining a fracture pressure of the shale reservoir at which the hydrocarbon-containing composition causes the shale reservoir to fracture;

(c) determining a maximum injection rate and a maximum injection pressure in a well to be utilized during the injection period, wherein the maximum injection pressure results in a near wellbore reservoir pressure that is at least the shale reservoir fracture pressure;

(d) injecting the hydrocarbon-containing composition into the shale reservoir during the injection period so as to create fractures and displace a portion of the hydrocarbon-containing composition into the created fractures, wherein the injection period comprises a period of time during which the near wellbore reservoir pressure of the well reaches at least the shale reservoir fracture pressure, and while continuing with the injecting of the hydrocarbon-containing composition, the near wellbore reservoir pressure is maintained at or above the shale reservoir fracture pressure for a pre-determined period of time of the injection period;

(e) determining a maximum production rate of gases and liquids from the well and a minimum production pressure at the well to be utilized during the production period;

(f) producing the well to obtain produced hydrocarbon fluids during the production period in the plurality of production periods for a period of time such that the pressure at the well reaches the determined minimum production pressure;

(g) during the production period, assessing composition of the produced hydrocarbon fluids and utilizing a compositional reservoir simulation model to determine a composition of residual hydrocarbons in the shale reservoir;

(h) utilizing a hydrocarbon processing apparatus to recover a portion of the hydrocarbon-containing composition from the produced hydrocarbon fluids, wherein the hydrocarbon processing apparatus comprises equipment selected from a group consisting of stage separators, compressors, refrigeration units, joule-thompson units, fractionation and stabilization units; chemical additives storage and injection pumps; gauges, sensors, controls, supervisory control and data acquisition (SCADA) equipment, heat exchangers, coolers, vessels, and combinations thereof, (i) processing the produced hydrocarbon fluids above ground with the hydrocarbon processing apparatus to remove (1) methane and ethane gases, (2) hydrocarbons containing hexanes, and (3) hydrocarbons having a molecular weight greater than hexane;

(j) determining a composition of an adjusted hydrocarbon-containing composition for injection based upon the composition of the residual hydrocarbons in the shale reservoir determined in step (g);

(k) adjusting the portion of the hydrocarbon-containing composition recovered utilizing the hydrocarbon processing apparatus to the composition of the adjusted hydrocarbon-containing composition and thereby forming an adjusted recovered portion of the hydrocarbon-containing composition;

(l) repeating steps (b) through (k) utilizing the adjusted recovered portion of the hydrocarbon-containing composition as the hydrocarbon-containing composition for injection.

2. The method of claim 1, wherein the method does not comprise a shut-in or soaking step between the step of injecting in step (d) and the step of producing in step (f).

3. The method of claim 1, wherein the method comprises a shut-in or soaking step between the step of injecting in step (d) and the step of producing in step (f).

4. The method of claim 1, wherein the hydrocarbon-containing composition comprises a fluid selected from a group consisting of propane, butane, and combinations thereof.

5. The method of claim 4, wherein the hydrocarbon-containing composition further comprises carbon monoxide.

6. The method of claim 1, wherein the hydrocarbon-containing composition comprises a material selected from a group consisting of liquid surfactants, nano-surfactants, nanoparticles, and combinations thereof.

7. The method of claim 1, wherein the step of utilizing the compositional reservoir simulation model comprises utilizing the compositional reservoir simulation model to increase recovery of residual crude oil.

8. The method of claim 1, wherein the step of determining the maximum injection rate and the maximum injection pressure during the injection period is based upon at least one of surface facilities capacities, reservoir conditions, wellbore conditions, and operation constraints.

9. The method of claim 1, wherein the step of determining the maximum production rate and the minimum production pressure during the production period is based upon at least one of surface facilities capacities, reservoir conditions, wellbore conditions, and operation constraints.

10. The method of claim 1, wherein the hydrocarbon processing apparatus further comprises hydrogen sulfide removal equipment, carbon dioxide removal equipment, or both.

11. The method of claim 1, wherein the method further comprises determining or estimating extent of formation fracturing and location of the formation fracturing during the injecting of the hydrocarbon-containing composition in step (d), wherein the step of determining or estimating the extent of formation fractioning is performed utilizing equipment selected from a group consisting of microseismic measurement equipment, formation resistivity measurement equipment, surface deformation equipment, and combinations thereof.

12. The method of claim 1, wherein a proppant material is injected with the hydrocarbon-containing composition, wherein the proppant comprises a solid selected from a group consisting of sand, ceramic, bauxite, petcoke, polymer, and combinations thereof.

* * * * *